US008372106B2

(12) United States Patent
Reil et al.

(10) Patent No.: US 8,372,106 B2
(45) Date of Patent: Feb. 12, 2013

(54) BODY PIERCING ASSEMBLY

(76) Inventors: Vladimir Reil, Rancho Palos Verdes, CA (US); Tomoyuki Takahashi, Seoul (KR)

( * ) Notice: Subject to any disclaimer, the term of this patent is extended or adjusted under 35 U.S.C. 154(b) by 766 days.

(21) Appl. No.: 11/258,530

(22) Filed: Oct. 25, 2005

(65) Prior Publication Data

US 2006/0224173 A1 Oct. 5, 2006

(30) Foreign Application Priority Data

Apr. 1, 2005 (KR) ..... 10-2005-0027592

(51) Int. Cl.
*A61B 17/34* (2006.01)

(52) U.S. Cl. ..... 606/188

(58) Field of Classification Search ..... 606/188, 606/185, 167; 63/12
See application file for complete search history.

(56) References Cited

U.S. PATENT DOCUMENTS

| | | | | |
|---|---|---|---|---|
| 2,713,863 | A * | 7/1955 | Handerson | 606/188 |
| 3,500,829 | A * | 3/1970 | Abramowitz | 604/170.01 |
| 3,789,850 | A * | 2/1974 | Ford | 606/188 |
| 3,943,935 | A * | 3/1976 | Cameron | 606/188 |
| 3,945,089 | A | 3/1976 | Gagnon | |
| 4,146,032 | A | 3/1979 | Rubenstein et al. | |
| 4,184,343 | A | 1/1980 | Green | |
| 4,195,492 | A | 4/1980 | Johnson | |
| 4,214,456 | A | 7/1980 | Hannum | |
| 4,259,850 | A | 4/1981 | Lalieu | |
| 4,397,067 | A | 8/1983 | Rapseik | |
| 4,631,929 | A | 12/1986 | Hollingworth | |
| 4,781,036 | A * | 11/1988 | Erickson | 63/12 |
| 4,907,425 | A | 3/1990 | Elkin | |
| 5,004,471 | A | 4/1991 | Mann | |
| 5,140,840 | A | 8/1992 | Miceli | |
| 5,154,068 | A | 10/1992 | DiDomenico | |

(Continued)

FOREIGN PATENT DOCUMENTS

| | | |
|---|---|---|
| EP | 0761119 A1 | 12/1997 |
| GB | 2149305 A | 10/1983 |

(Continued)

OTHER PUBLICATIONS

Unimax Piercing Needles, Loose, Steril, All Gauges—Internally Threaded, Oct. 2, 2005; http://unimaxsupply.com; 5 pages.*

(Continued)

*Primary Examiner* — S. Thomas Hughes
*Assistant Examiner* — Sarah Simpson
(74) *Attorney, Agent, or Firm* — Canady & Lortz LLP; Bradley K. Lortz

(57) ABSTRACT

Apparatuses and methods for a ornamental piercing of body parts are disclosed. Various embodiments of the invention employ a coupling needle in a cartridge which is used to pierce a body part and subsequently detached and replaced with a nut (such as a spherical cap). The coupling needle in the cartridge may be implemented as a component in a piercing system, e.g. using a sterile, disposable cartridge that is operated with a piercing gun. After piercing, the coupling needle may be used to draw a coupled ornamental piece through the pierced hole after which the coupling needle is detached and a nut or spherical cap is attached in its place to complete the piercing. The ornamental piece may be coupled to the coupling needle within the cartridge and operated with the piercing system or it may be attached after piercing.

18 Claims, 15 Drawing Sheets

U.S. PATENT DOCUMENTS

| | | | | |
|---|---|---|---|---|
| 5,201,197 | A | 4/1993 | Bakker | |
| 5,454,829 | A | 10/1995 | Koland | |
| 5,456,094 | A | 10/1995 | Greenwald | |
| D366,316 | S | 1/1996 | Reil | |
| 5,496,343 | A | 3/1996 | Reil | |
| 5,499,993 | A | 3/1996 | Blomdahl et al. | |
| 5,588,309 | A | 12/1996 | Chioffe | |
| 5,632,163 | A | 5/1997 | Inoue | |
| D384,302 | S | 9/1997 | Reil | |
| 5,675,987 | A | 10/1997 | Nakajima | |
| D392,042 | S | 3/1998 | Reil | |
| 5,743,113 | A | 4/1998 | Kogen | |
| 5,792,170 | A | 8/1998 | Reil | |
| 5,868,774 | A | 2/1999 | Reil | |
| 6,036,712 | A | 3/2000 | Blomdahl | |
| D424,695 | S * | 5/2000 | Reil | D24/146 |
| 6,099,545 | A | 8/2000 | Mann et al. | |
| 6,105,392 | A | 8/2000 | Biagi | |
| 6,183,490 | B1 | 2/2001 | Korbar et al. | |
| 6,599,306 | B1 * | 7/2003 | Reil | 606/188 |
| 2005/0005643 | A1 * | 1/2005 | Hollis | 63/35 |

FOREIGN PATENT DOCUMENTS

| | | |
|---|---|---|
| GB | 2310378 | 8/1997 |
| JP | 08196313 | 8/1996 |
| JP | 08322615 | 12/1996 |
| JP | 09224722 | 9/1997 |
| JP | 11299512 | 11/1999 |
| JP | 11299512 | 2/2000 |
| KR | 20-0307423 | 3/2003 |

OTHER PUBLICATIONS

International Search Report for PCT/IB2006/050658.

* cited by examiner

BODY PIERCING ASSEMBLY

CROSS-REFERENCE TO RELATED APPLICATIONS

This application claims the benefit under 35 U.S.C. §119 of the following foreign patent application, which is incorporated by reference herein:

Republic of Korea Patent Application No. 10-2005-0027592, filed Apr. 1, 2005, and entitled "COUPLING STRUCTURE OF PIERCING ACCESSORY", by Vladimir Reil and Tomoyuki Takahashi.

BACKGROUND OF THE INVENTION

1. Field of the Invention

The present invention relates to apparatuses and methods for ornamental piercing of body parts. Particularly, the present invention relates to apparatuses and methods for manual body piercing and body piercing performed with hand-operated instruments.

2. Description of the Related Art

In recent years, body piercing has become an increasingly common practice in the U.S. and throughout the world. The practice is rapidly becoming a routine procedure, often performed by laypersons without medical experience or training. Presently, a number of manually operated devices are available that allow for the safe, hygienic, user-friendly piercing of body parts. Examples of such systems are disclosed in U.S. Pat. No. 5,496,343 by Reil, issued Mar. 5, 1996, U.S. Pat. No. 5,792,170 by Reil, issued Aug. 11, 1998, U.S. Pat. No. 5,868,774 by Reil, issued Feb. 9, 1999, U.S. Pat. No. 6,599,306 by Reil, issued Jul. 29, 2003, and U.S. Pat. No. 6,796,990 by Reil, issued Sep. 28, 2004, all of which are incorporated by reference herein.

In addition to piercing entirely by hand with a needle, there are a variety of piercing systems available today. These various piercing systems essentially comprise a stud (also called an earring or a piercing earring) which includes an affixed ornamental piece with a post (also called a pin or a piercing pin) and a nut (sometimes called a clasp) that are mounted in a cartridge. During the piercing process, the body part (e.g., an ear lobe) is placed between the post and the nut and the cartridge is squeezed, either by hand or by operating it in a special stud gun, which causes the post to pierce the body part and engage the nut.

FIG. 1A illustrates a body piercing assembly in a prior art body piercing system 100. The system employs a body piercing assembly of a disposable cartridge 102 which is used to perform the piercing. The cartridge 102 provides two elements engaged to slide in opposition and perform the piercing. The cartridge has a first element pre-loaded with a carrier 110 supporting a stud 104 which comprises a post and an ornamental piece 106 (which may be no more than a metal spherical end) affixed to one end of the post. The opposing end of the post comprises a barb 108 which is sharpened for piercing a body part but also includes a hooking feature. During the piercing the two elements of the cartridge 102 are moved together to drive the sharpened barb 108 through the body part to be pierced. A nut 112 is disposed in the other element of the cartridge 102 aligned to engage the barb 108 as it emerges from the pierced body part. After piercing, the two halves of the carrier 110 are released from the first element of the cartridge 102 and fall away from the stud. The engaged nut 112 slides free from the second element of the cartridge 102 and serves to cover the sharpened barb 108 and protect the wearer. The hooking feature of the barb 108 serves to prevent accidental disengagement of the nut 112 from the post.

FIGS. 1-1D illustrate operation of the prior art body piercing system 100. FIG. 1B shows the two elements of the cartridge 102 in preparation for piercing with the body part 116 to be piercing in position between the stud 104 and the nut 112. The sliding engagement 114 of the two elements is spring loaded to facilitate release of the piercing. FIG. 1C shows the cartridge 102 during piercing. The body part 116 has been pierced by the stud 104 as the two elements of the cartridge 102 are brought together. FIG. 1D shows the cartridge 102 after piercing. The carrier 110 is released from the first element of the cartridge 102 and has released the stud 104. The stud 104 is engaged with the nut 112 which slides free of the second element of the cartridge 102. The system and process described works well to provide ornamental piercing of body parts, particularly ears.

However, it is important to understand that mainstream body piercing has evolved to include piercing of body parts other than just the ear. For example, piercing of flesh near the naval or belly button, eyebrow, lip, etc., are presently much more common than previously. Piercing of such atypical body parts can present additional difficulty. For example, it can be difficult to attach the nut to the post when piercing a location without a convenient flap of skin such as an earlobe. In preparation for piercing a flap of skin may be artificially formed by pinching the desired location. When the skin is released after piercing, the post tends to draw into the skin making it hard to manipulate and secure the nut (which may be a spherical cap) to the post. In addition, the size and location of the piercing ornament may only compound this trouble.

In view of the foregoing, there is a need for methods and apparatuses that provide for simple, accurate, repeatable and safe piercing, particularly when piercing atypical body parts which do not present a convenient flap of skin. Further, there is also a need for such methods and apparatuses to be made compatible with existing systems, minimizing additional and separate components and mechanisms. There is also a need for such methods and apparatuses to employ standard components which can be employed with different piercing techniques. As discussed hereafter, the present invention meets these and other needs.

SUMMARY OF THE INVENTION

Apparatuses and methods for a ornamental piercing of body parts are disclosed. Various embodiments of the invention employ a coupling needle in a cartridge which is used to pierce a body part and subsequently detached and replaced with a nut (such as a spherical cap). The coupling needle in the cartridge may be implemented as a component in a piercing system, e.g. using a sterile, disposable cartridge that is operated with a piercing gun. After piercing, the coupling needle may be used to draw a coupled ornamental piece through the pierced hole after which the coupling needle is detached and a nut or spherical cap is attached in its place to complete the piercing. The ornamental piece may be coupled to the coupling needle within the cartridge and operated with the piercing system or it may be attached after piercing.

A typical embodiment of the invention comprises a body piercing assembly including a coupling needle having a sharpened end for piercing a body part and a coupling end for coupling to an ornamental piece opposite the sharpened end and a cartridge for carrying the coupling needle and for piercing the body part with the coupling needle. The cartridge may be sterile packaged and be designed to function alone or as part of a body piercing system. For example, such a body piercing system may comprise a hand-operating instrument into which the cartridge is loaded. Typically, the ornamental piece comprises a post and ornamental end. The post may be straight or curved depending upon the piercing location and/or aesthetic preference.

In some embodiments, the ornamental piece is coupled to the coupling needle and carried within the cartridge. Alternately, the coupling needle may be carried within the cartridge without the ornamental piece. In this case, the ornamental piece is coupled to the coupling needle after piercing the body part with the coupling needle.

In further embodiments, the cartridge may include a coupling needle manipulator for engaging the sharpened end of the coupling needle after the body part is pierced such that the coupling needle manipulator then carries the coupling needle. The coupling needle manipulator allows the user to easily handle the coupling needle to complete the piercing by providing a more sizable element to grasp.

A typical method of body piercing, comprises the steps of operating a cartridge carrying a coupling needle to pierce a body part with the coupling needle and disengaging the coupling needle from the cartridge after piercing the body part. The coupling needle has a sharpened end for piercing a body part and a coupling end for coupling to an ornamental piece opposite the sharpened end. Method embodiments of the invention may be further modified consistent with the apparatus embodiments described above.

In some embodiments the ornamental piece may be coupled to the coupling needle after piercing the body part with the coupling needle. In this case, the coupling needle is carried within the cartridge without the ornamental piece. Alternately, the ornamental piece may be coupled to the coupling needle and carried within the cartridge.

The cartridge may include a coupling needle manipulator for engaging the sharpened end of the coupling needle after the body part is pierced such that the coupling needle manipulator carries the coupling needle. The method may include drawing the ornamental piece through the pierced body part with the coupling needle, manipulating the coupling needle manipulator to decouple the coupling needle from the ornamental piece and coupling a coupling nut to the ornamental piece in place of the decoupled coupling needle. The ornamental piece may be coupled to the coupling needle and carried within the cartridge or the coupling needle may be carried within the cartridge without the ornamental piece. If the coupling needle is carried within the cartridge without the ornamental piece, the ornamental piece is coupled to the coupling needle after piercing the body part with the coupling needle.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description including the preferred embodiment, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

1.0 Overview

As mentioned above, various embodiments of the invention employ a coupling needle in a cartridge which may be used to pierce a body part and is subsequently detached and replaced with a nut (such as a spherical cap). The coupling needle in the cartridge may be implemented as a component in a piercing system, e.g. using a sterile, disposable cartridge that is operated with a piercing instrument. After piercing, the coupling needle may be used to draw a coupled ornamental piece through the pierced hole after which the coupling needle is detached and a nut or spherical cap is attached in its place to complete the piercing. The ornamental piece may be coupled to the coupling needle within the cartridge and operated with the piercing system or it may be attached after piercing.

For some examples of cartridges, see e.g. U.S. Pat. No. 5,792,170 by Reil, issued Aug. 11, 1998 and U.S. Pat. No. 5,913,869 by Reil, issued Jun. 22, 1999, both of which are incorporated by reference herein. Such cartridges can be adapted to operate with embodiments of the invention as will be understood by those skilled in the art.

2.0 Coupling Needle

Figure 1A:
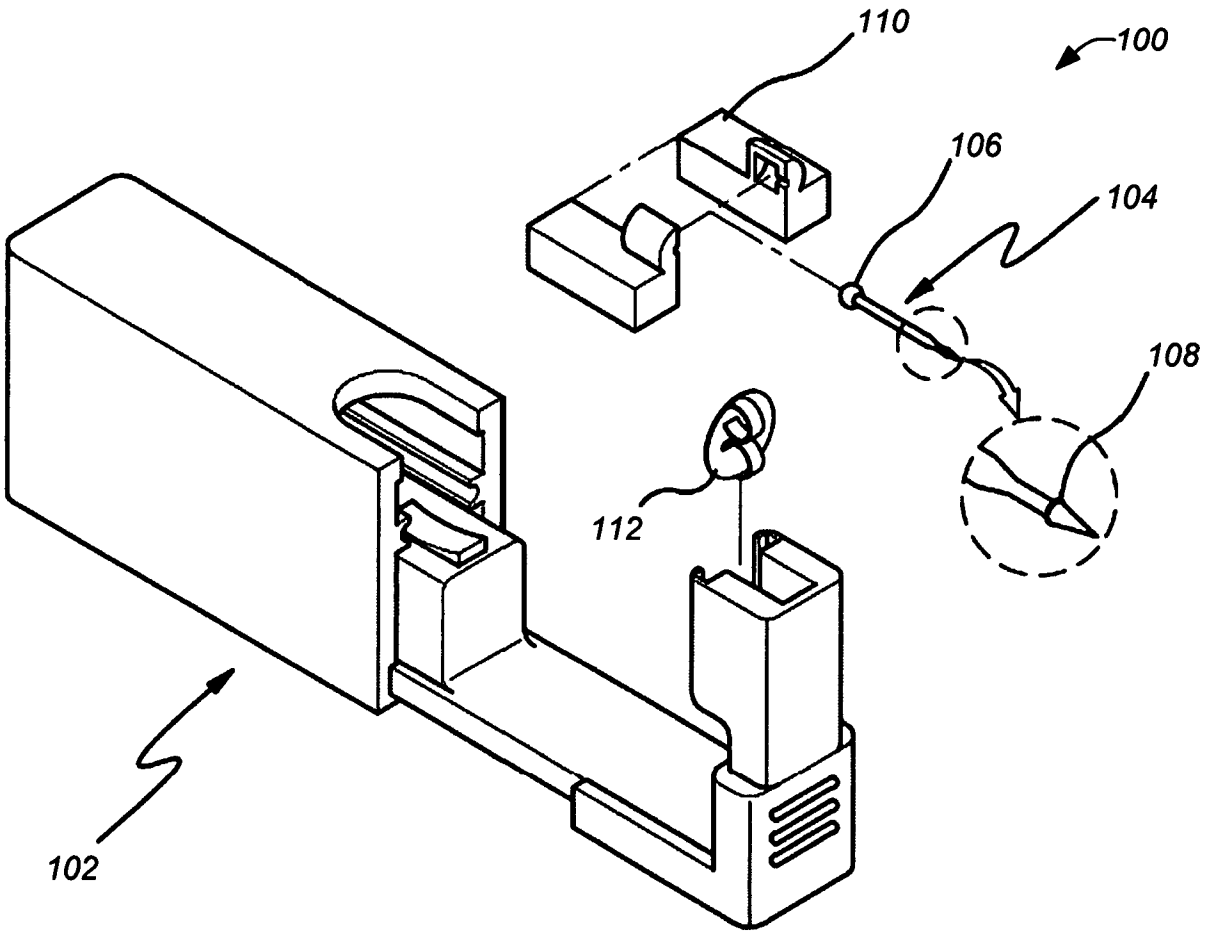
FIG. 1A Prior Art
FIG. 1A illustrates a body piercing assembly in a prior art body piercing system.
Figure 1B:
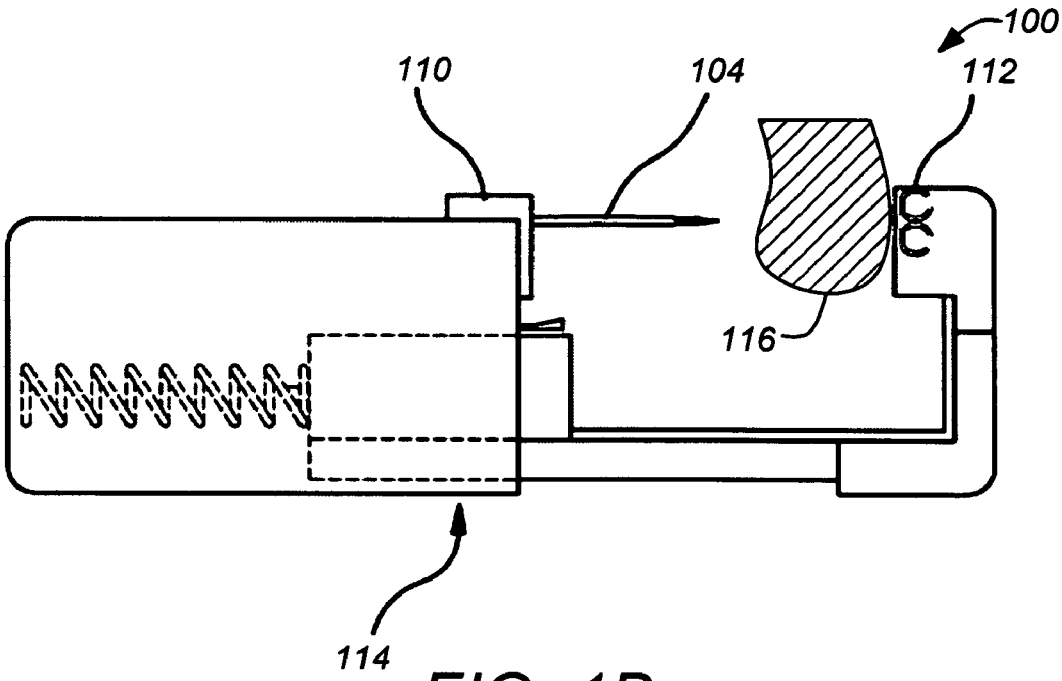
FIG. 1B Prior Art
FIGS. 1B-1D illustrate operation of the prior art body piercing system.
Figure 1C:
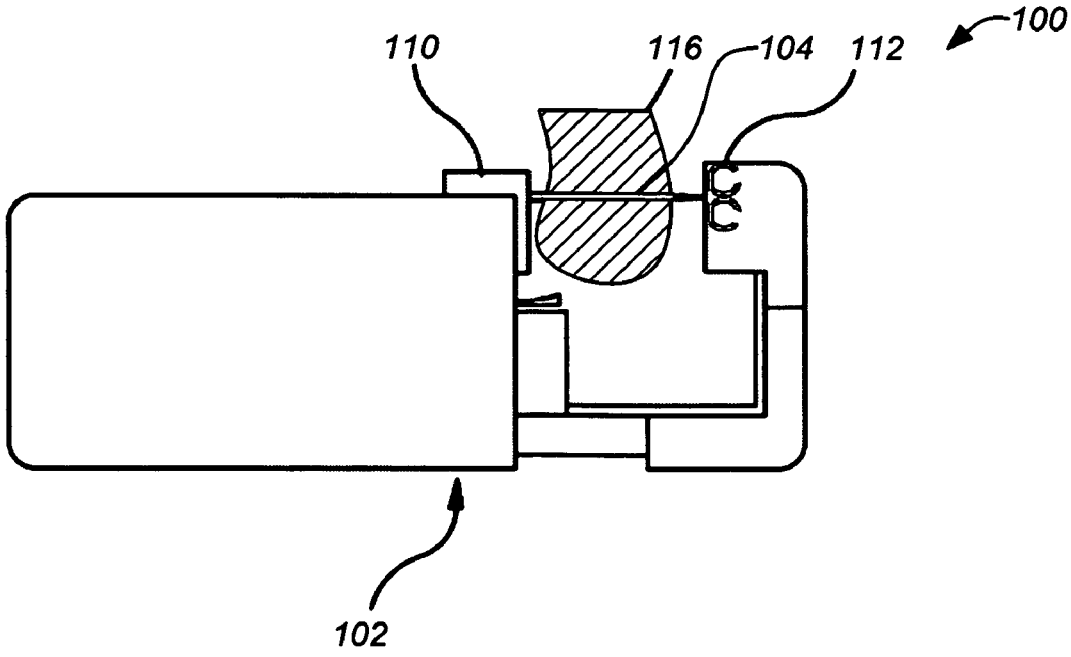
FIG. 1C Prior Art
Figure 1D:
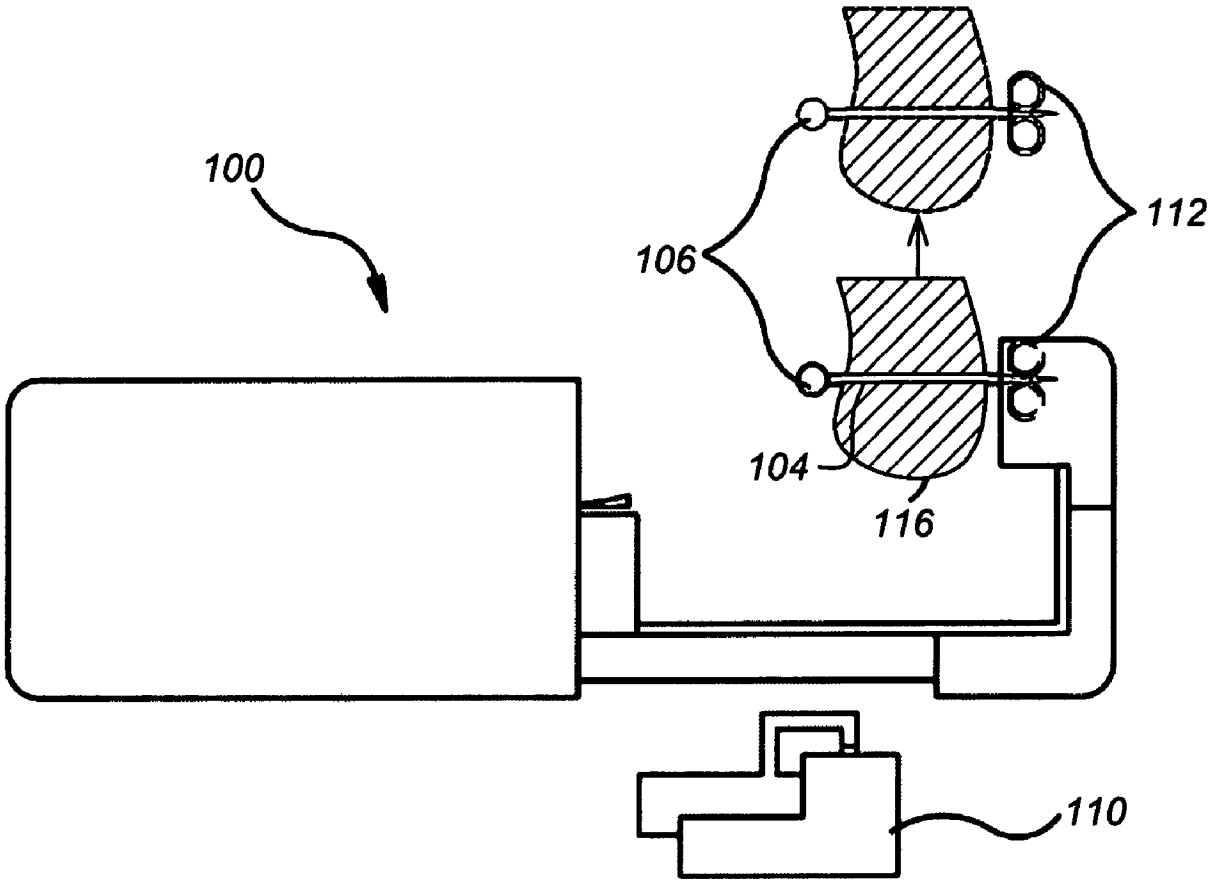
FIG. 1D Prior Art
Figure 2:
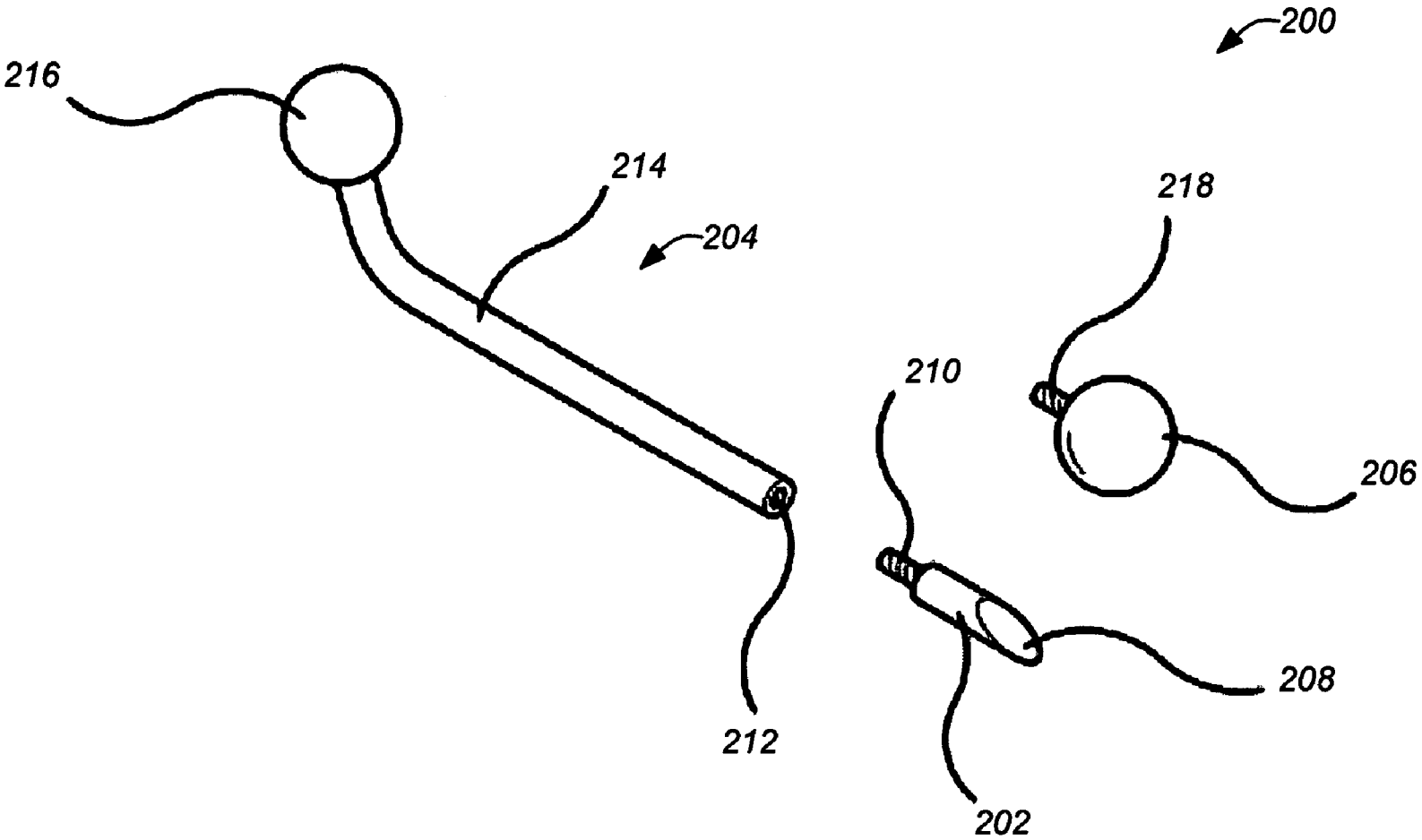
FIG. 2 illustrates a body piercing assembly comprising the components of a coupling needle, ornamental piece and nut components for embodiments of the invention.

FIG. 2 illustrates a body piercing assembly 200 comprising the components of a coupling needle 202, ornamental piece 204 and coupling nut 206 components for embodiments of the invention. The coupling needle 202 includes a sharpened end 208 for piercing a body part and a coupling end 210 opposite the sharpened end 208. The coupling end 210 of the coupling needle 202 is designed to couple to an ornamental piece 204. The coupling needle 202 is a disposable component of the body piercing assembly 200 employed to perform the piercing of a body part.

The coupling end 210 is shown as a male thread, however embodiments of the invention are not limited to a male thread coupling end 210. For example, the coupling end 210 may comprises a female thread, a snap-fitting or any other suitable mechanical engagement. In any case however, the coupling end 210 of the coupling needle 202 must be adapted to join to the ornamental piece 204. Accordingly, the ornamental piece 204 comprises a matching coupling end 212 for the coupling end 210 of the coupling needle 202. The matching coupling end 212 of the ornamental piece 204 is the counterpart to the coupling end 210 of the coupling needle 202 (e.g. the female thread, the matching snap fitting, etc.). When the coupling end 210 is joined to the matching coupling end 212 of the ornamental piece 204 there should be a substantially smooth transition between the two components. This transition will be passed through the new piercing and there should be no irregularities that might inhibit or prevent the movement. In addition, the coupling end 210 of the coupling needle 202 is also duplicated on the nut 206 as the nut coupler 218 because the coupling nut 206 is designed to replace the coupling needle 202 and close out the piercing.

Typically, the ornamental piece 204 comprises a post 214 and ornamental end 216 (opposite the matching coupling end 212). The post 214 may be straight or curved depending upon the piercing location or aesthetic preference. For example, a curved post 214 may be more appropriate for piercing in areas where there is not a convenient flap of skin as there is with an earlobe. A curved post 214 may be typically employed for a navel piercing with the ornamental end 216 situated in the center of the navel and the post 214 and coupling nut 206 above. In addition, as the ornamental piece 204 is often a primary consideration of the wearer, it can vary in style or design (e.g. including different colors, shapes, embedded stones, etc.) depending upon the aesthetic preference of the wearer.

As shall be detailed hereafter, the ornamental piece 204 may be coupled to the coupling needle 202 and carried within a cartridge for a body piercing system. Alternately, the coupling needle 202 may be carried within the cartridge without the ornamental piece 204. In this case, the ornamental piece 204 is coupled to the coupling needle 202 after piercing the body part with the coupling needle 202.

3.0 Coupling Needle in Cartridge with Ornamental Piece

Figure 3A:
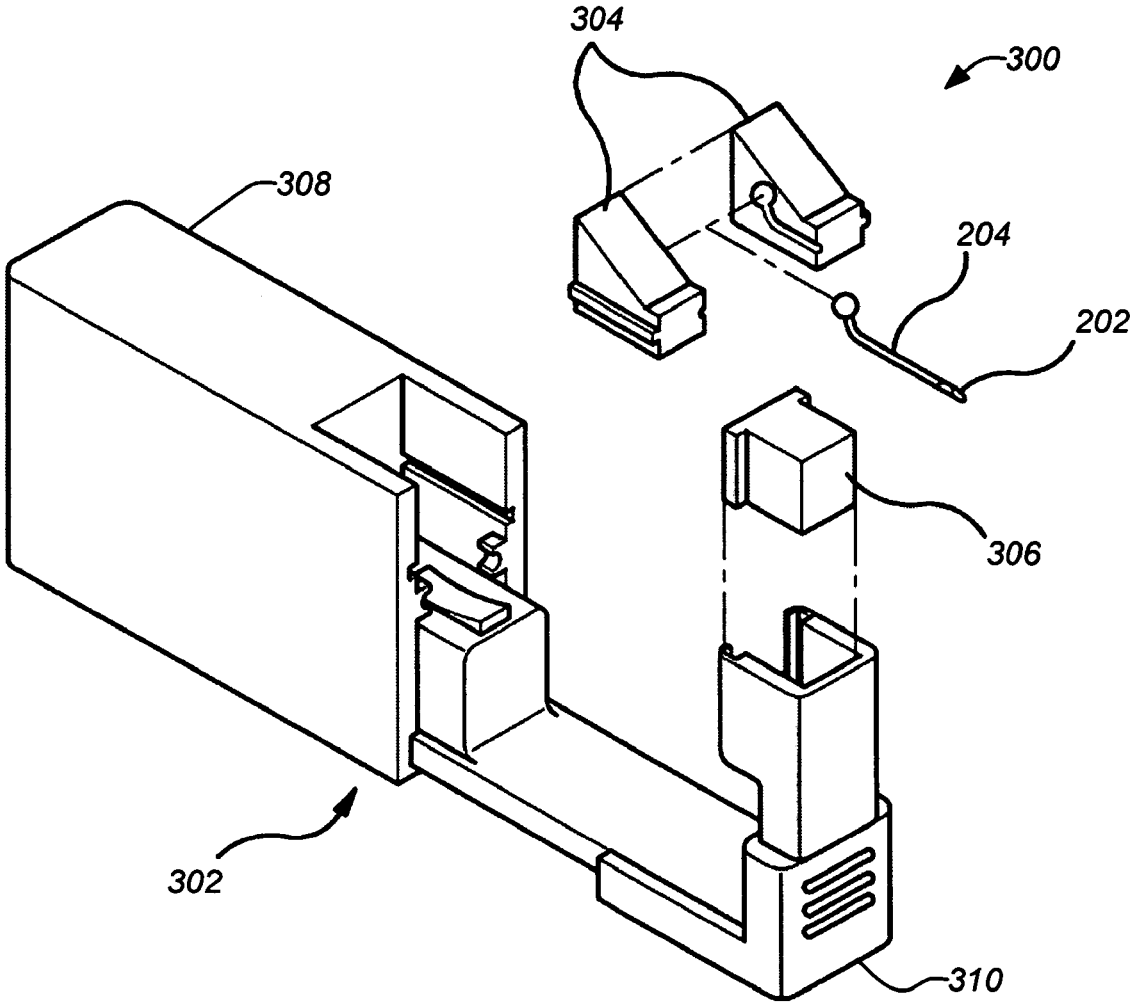
FIG. 3A illustrates a typical body piercing assembly embodiment of the invention including a coupling needle and ornamental piece carried in a cartridge.

FIG. 3A illustrates a typical body piercing assembly 300 embodiment of the invention including a coupling needle 202 and ornamental piece 204 carried in a cartridge 302. In this embodiment, the coupling needle 202 and the ornamental piece 204 are coupled together and supported in a carrier 304. The carrier 304 comprises two halves, each having a hollow that engages at least a portion of the coupled ornamental piece 204 and coupling needle 202. Thus, the two halves enclose and support the coupled ornamental piece 204 and coupling needle 202. The carrier 304 includes features (e.g. guides) which engage the cartridge 302 with the halves together and supporting the coupling needle 202 and ornamental piece 204 in position for piercing. After piercing, the carrier 304 is released from the cartridge 302 and in turn releases the coupling needle 202 and ornamental piece 204 as the two halves of the carrier 304 are allowed to separate. The cartridge 302, carrying the coupled ornamental piece 204 and coupling needle 202, may be sterilized and package for convenient and safe use, e.g. with a hand-operated piercing instrument. As previously mentioned, the ornamental piece 204 typically comprises a post 214 and ornamental end 216 and the post 214 may be straight or curved depending upon the piercing location or aesthetic preference.

In further embodiments, the cartridge 304 may also include a coupling needle manipulator 306 for engaging the sharpened end 208 of the coupling needle 202 after the body part is pierced such that the coupling needle manipulator 306 then carries the coupling needle 202. The coupling needle manipulator 306 allows the user to easily handle the coupling needle 202 to complete the piercing by providing a more sizable element to grasp and uncouple the coupling needle 202 from the ornamental piece 204. The coupling needle 202 is typically relatively tiny and otherwise difficult to manipulate alone.

The coupling needle manipulator 306 includes features (e.g. guides) which engage the cartridge 302. In this case, the cartridge 302 includes two moving elements, a first element 308 for supporting the coupling needle 202 and ornamental piece 204 and a second element 310 for supporting the coupling needle manipulator 306. The coupling needle manipulator 306 is aligned with the sharpened end 208 of the coupling needle 202 such that the sharpened end 208 embeds itself into the coupling needle manipulator 306 after piercing the body part.

The sharpened end 208 of the coupling needle 202 may have any configuration which is capable of piercing a body part. For example, the sharpened end 208 may comprise a conical point, a single cut taper, or any other shape suitable for body piercing. However, where a thread is employed as the coupling element of the coupling needle 202, it is desirable that the sharpened end 208 comprise an asymmetric shape (such as the single cut taper shown) and/or some asymmetric feature. When an asymmetric shape becomes embedded in the coupling needle manipulator 306, the coupling needle 202 may be rotated (e.g., to engage or disengage the thread) without sharpened end 208 slipping in the coupling needle manipulator 306. Such asymmetry is determined about a central axis of the coupling needle 202.

Figure 3B:
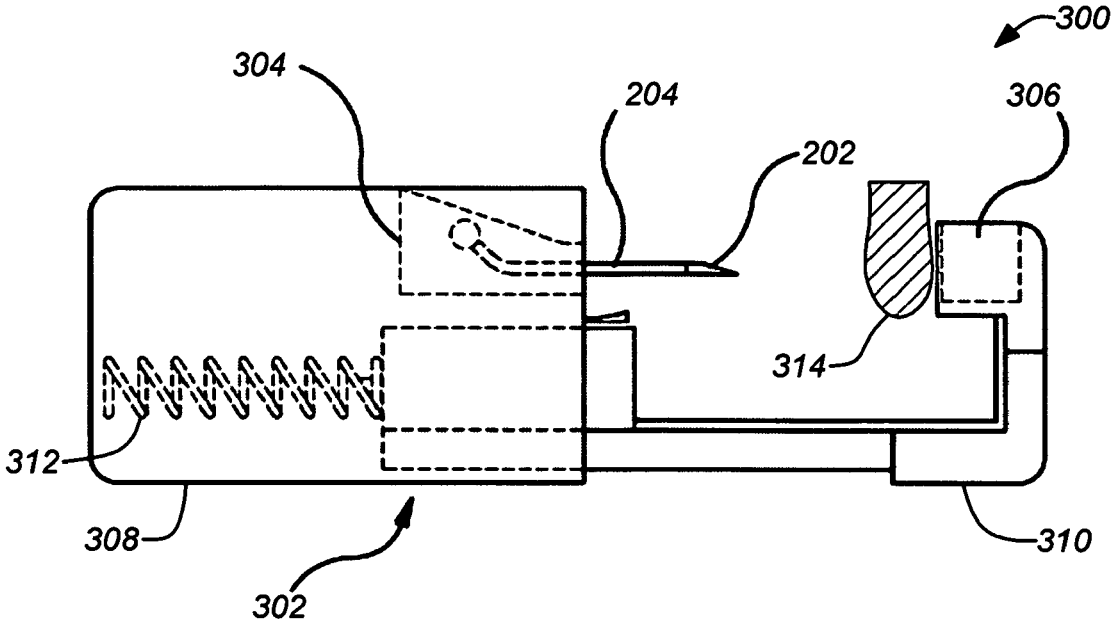
FIGS. 3B-3D illustrate operation of a body piercing assembly embodiment of the invention including a coupling needle and ornamental piece carried in a cartridge.
Figure 3C:
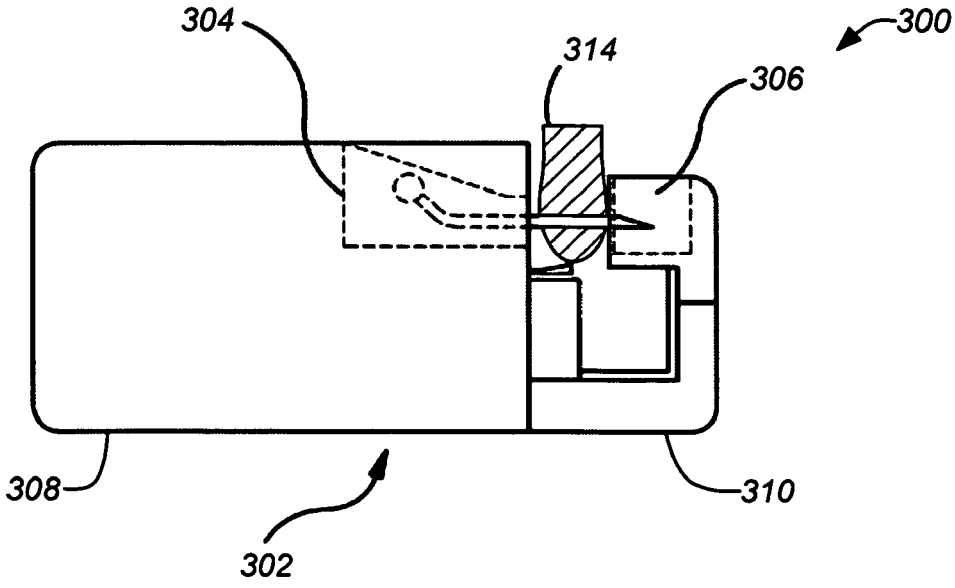
Figure 3D:
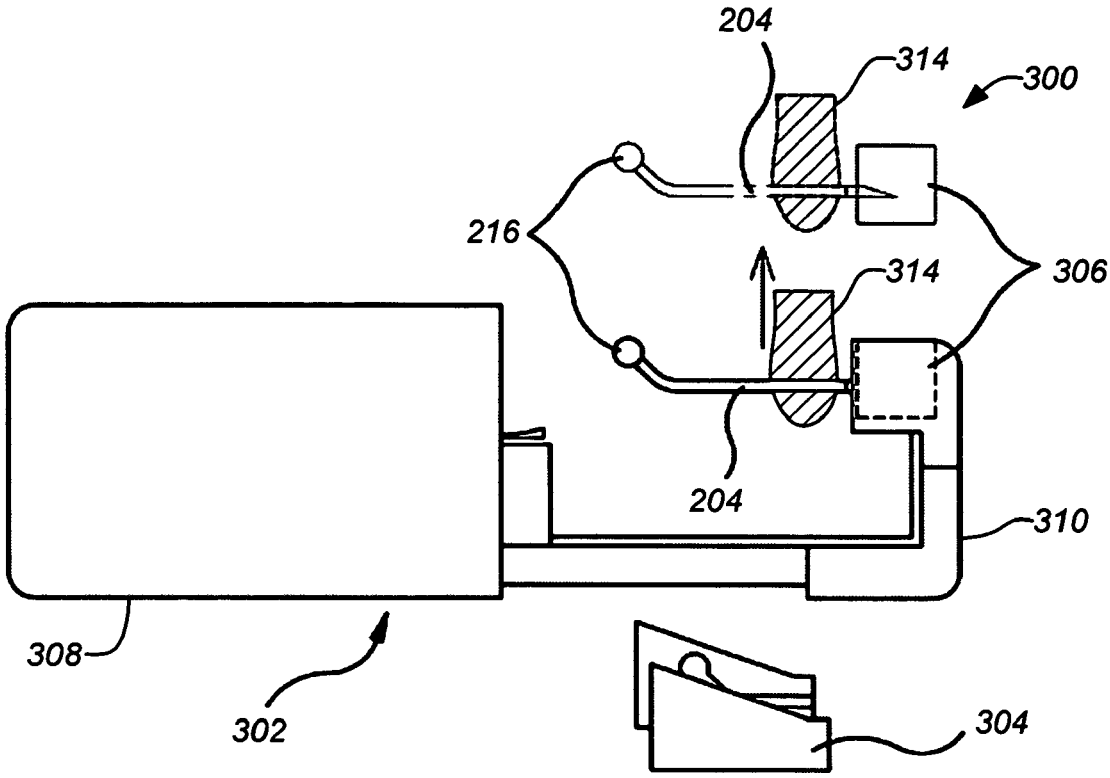

FIGS. 3B-3D illustrate operation of a body piercing assembly 300 embodiment of the invention including a coupling needle 202 and ornamental piece 204 carried in a cartridge 302. FIG. 3B shows the cartridge 302 in an open position ready for piercing with a body part 314 to be pierced disposed between the sharpened end 208 of the coupling needle 202 and the coupling needle manipulator 306. The first and second elements 308, 310 of the cartridge 302 are spring loaded apart with the internal spring 312 in a sliding engagement as shown. FIG. 3C shows the cartridge 302 in a closed position after piercing the body part 314. The sharpened end 208 of the coupling needle 202 has pierced the body part 314 and become embedded in the coupling needle manipulator 306. FIG. 3D shows the cartridge 302 after piercing, again in the open position. Upon release, the spring 312 serves to drive the two elements 308, 310 apart. This action also causes the carrier 304 to be drawn out of the first element 308 of the cartridge 302 because the coupling needle 202 is embedded and held in the coupling needle manipulator 306 and the sliding engagement of the two elements 308, 310 is parallel to the sliding engagement of the carrier 304. (In addition, the coupling needle manipulator 306 has a sliding engagement that is not parallel to that of the two elements 308, 310 which holds it in place during this motion.) After the carrier 304 is released from the first element 308, the two halves fall away and the pierced body part 314 is released as the coupling needle manipulator 306 is allowed to slide free from the second element 310 of the cartridge 302. The coupling needle manipulator 306 serves to temporarily close off the piercing and prevents the ornamental piece 204 and coupling needle 202 from slipping out of the pierced body part 314 as the cartridge 302 is disengaged and released.

Figure 4A:
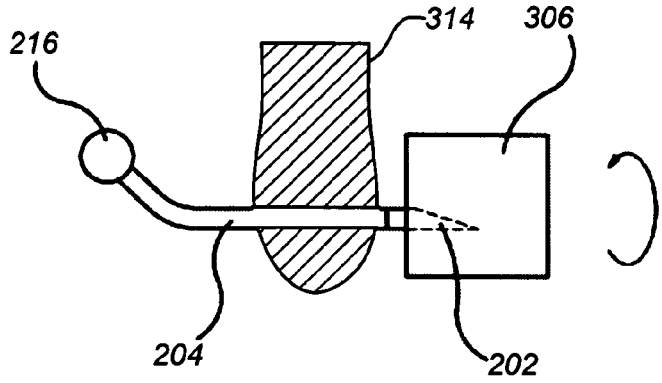
FIGS. 4A-4C illustrate further steps manipulating the coupling needle, ornamental piece and additional nut component to complete a piercing.
Figure 4B:
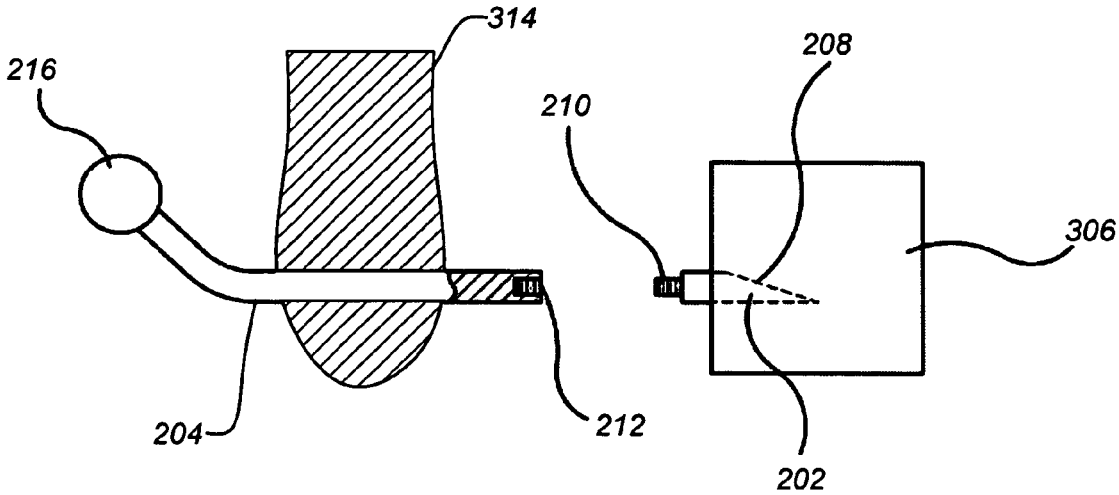
Figure 4C:
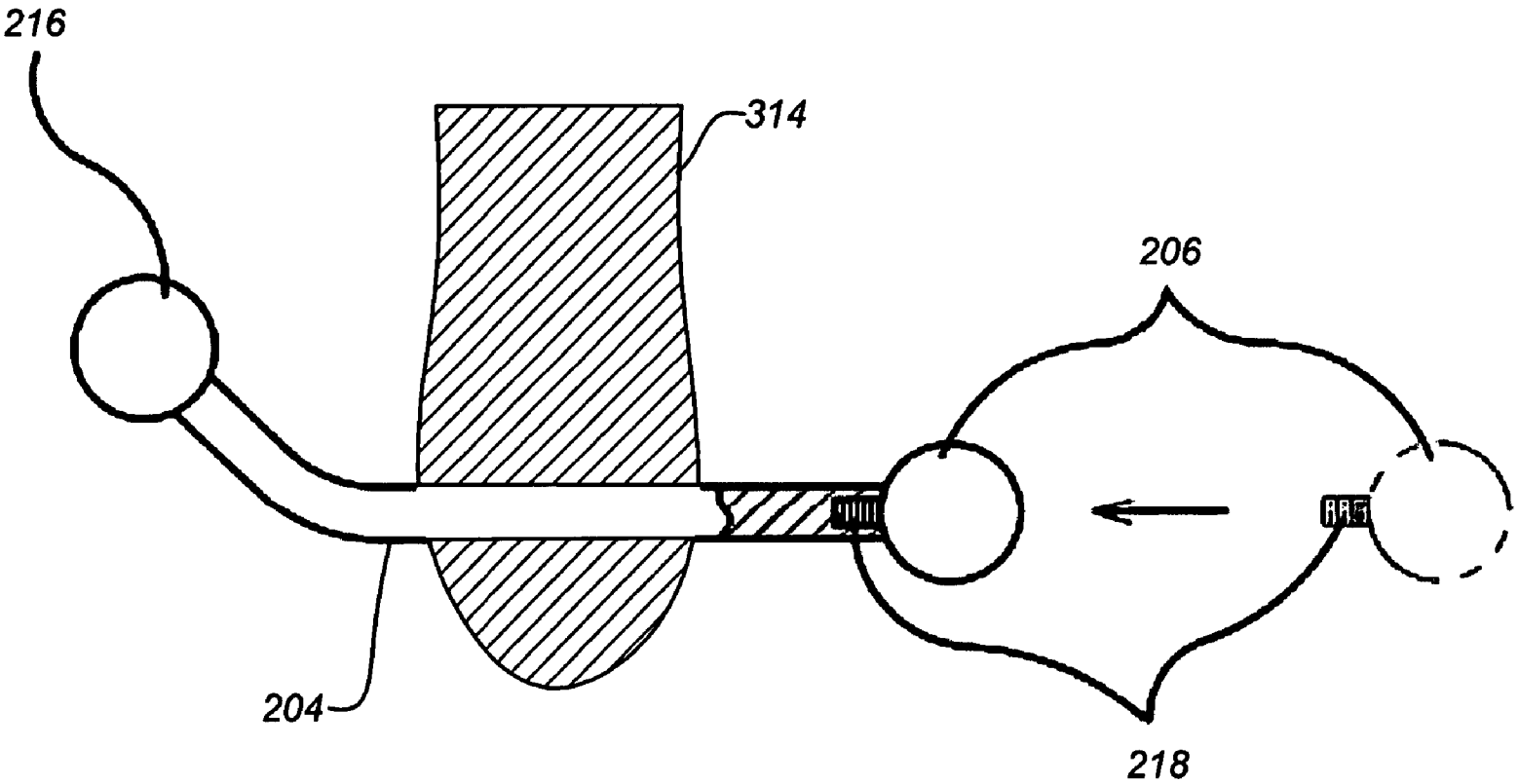

FIGS. 4A-4C illustrate further steps manipulating the coupling needle 202, ornamental piece 204 and a coupling nut 206 to complete the piercing. FIG. 4A shows coupling needle 202 embedded in the coupling needle manipulator 306 after being disengaged from the cartridge 302. The coupling needle 202 is decoupled from the ornamental piece 204 by rotating the coupling needle manipulator 306 with embedded coupling needle 202 relative to the ornamental piece 204 as shown. FIG. 4B shows the decoupled coupling needle 202, still embedded in the coupling needle manipulator 306 which may now be discarded. The ornamental piece 204 remains pierced through the body part 314. FIG. 4C shows the coupling needle 202 being replaced with a coupling nut 206. The nut coupler 218 of the coupling nut 206 is functionally identical to the coupling end 210 of the coupling needle 202 because the coupling nut 206 replaces the coupling needle 202 and close out the piercing. Variations between the coupling features of the coupling needle 202 and the coupling nut 206 are possible, but both components must be capable of coupling to the coupling end 212 of the ornamental piece 204.

4.0 Coupling Needle in Cartridge without Ornamental Piece

Figure 5A:
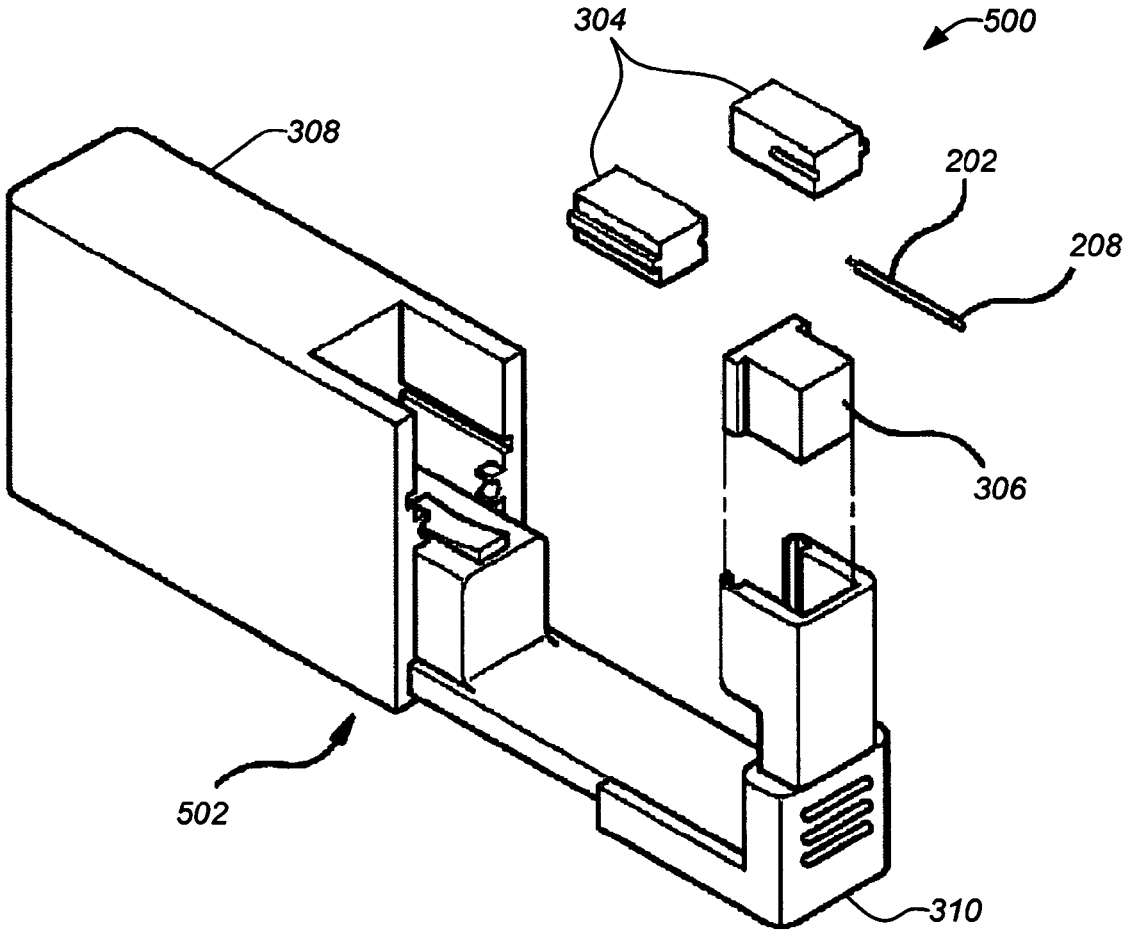
FIG. 5A illustrates an alternate embodiment of the invention where the cartridge is loaded with a coupling needle alone.

FIG. 5A illustrates an alternate assembly 500 where the cartridge 502 is loaded with a coupling needle 202 alone. This embodiment is desirable because the sterile packaged cartridge 502 is the common regardless of which style or design (e.g. color, shape) of ornamental piece 204 is employed in the piercing. In the previous cartridge 302, where the cartridge carries the ornamental piece 204, the desired ornamental piece 204 must be prepackaged in the cartridge. This requires a greater range of ornamental pieces in the packaging process. In contrast, every cartridge 502 employs only the coupling needle 202 which is discarded after the piercing is completed. Operation of the cartridge 502 is essentially the same as described above for cartridge 302 in FIGS. 3B-3D with a few minor differences described hereafter.

First, it is important to note that the coupling needle 202 is generally longer when used with the cartridge 502. This is because there must be adequate length to accommodate the pierced body part 314. With the previous cartridge 302, the ornamental piece 204 provided most of the length. In this case, however, the absence of the ornamental piece 204 in the cartridge 502 requires a longer coupling needle 202 to make up the difference.

In addition, because the coupling end 210 of the coupling needle 202 is not as large as an ornamental piece 204, an alternate design of the carrier 304 may be used. In this case, the carrier 304 may be a single piece with only a hole for the coupling needle 202 to engage. It is not necessary for the carrier 304 to be in two halves because the coupling needle 202 can simply be withdrawn from the hole. The hole may optionally include a coupling element, e.g., a female thread, to secured the coupling needle 202 in place until it is removed. This can help secure the new piercing and prevent the coupling needle 202 from accidentally slipping through the pierced body part 314 in a manner similar to the coupling needle manipulator 306 at the opposite end. Of course, the carrier 304 may still be employed as two halves as well, with each having a hollow that engages at least a portion of the coupling end 210 of the coupling needle 202 as shown.

Figure 5B:
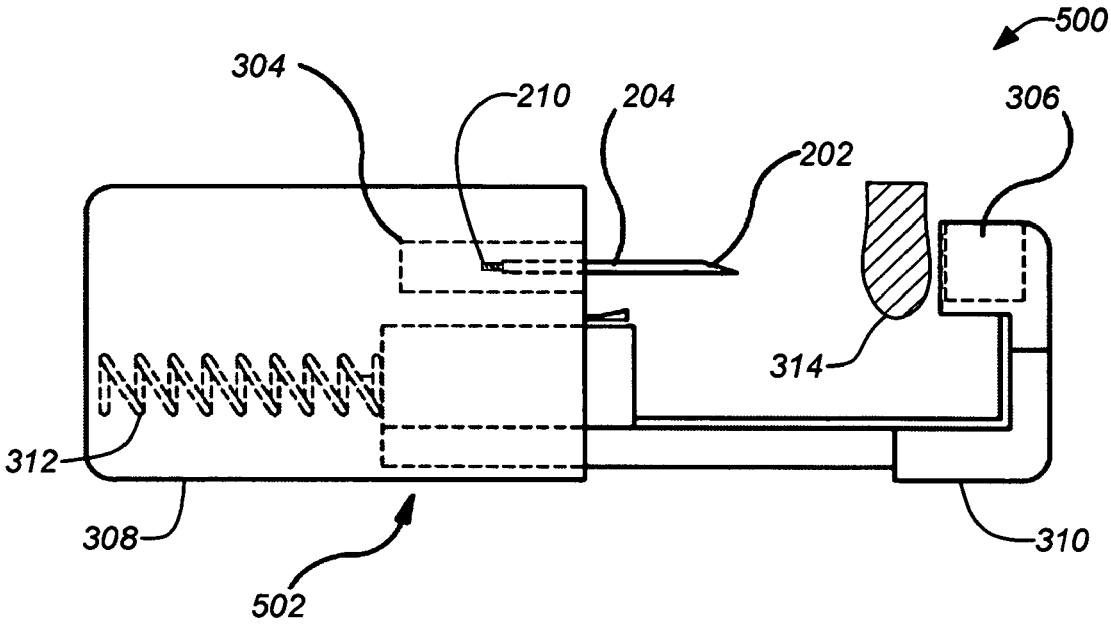
FIGS. 5B-5D illustrate operation of the alternate embodiment of the invention where the cartridge is loaded with a coupling needle alone.
Figure 5C:
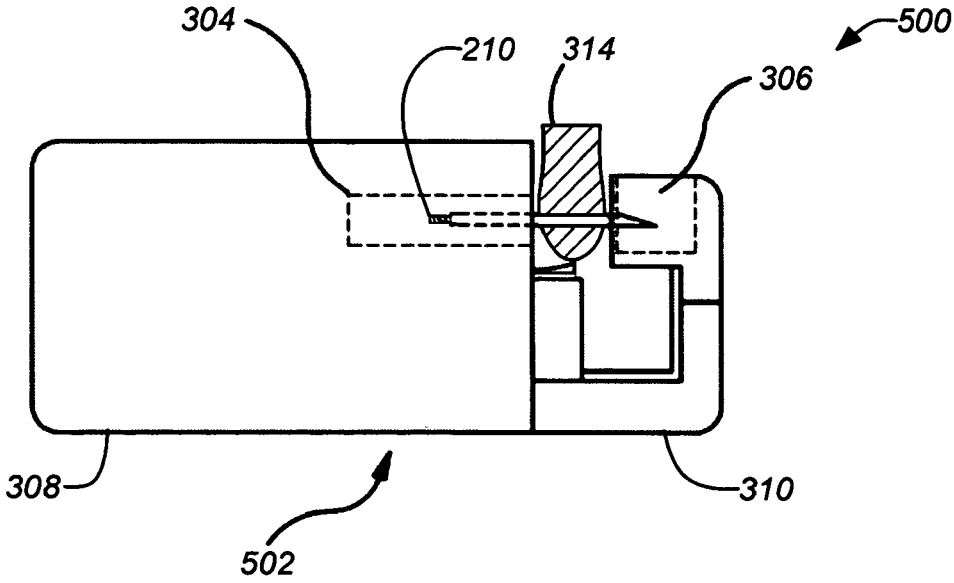
Figure 5D:
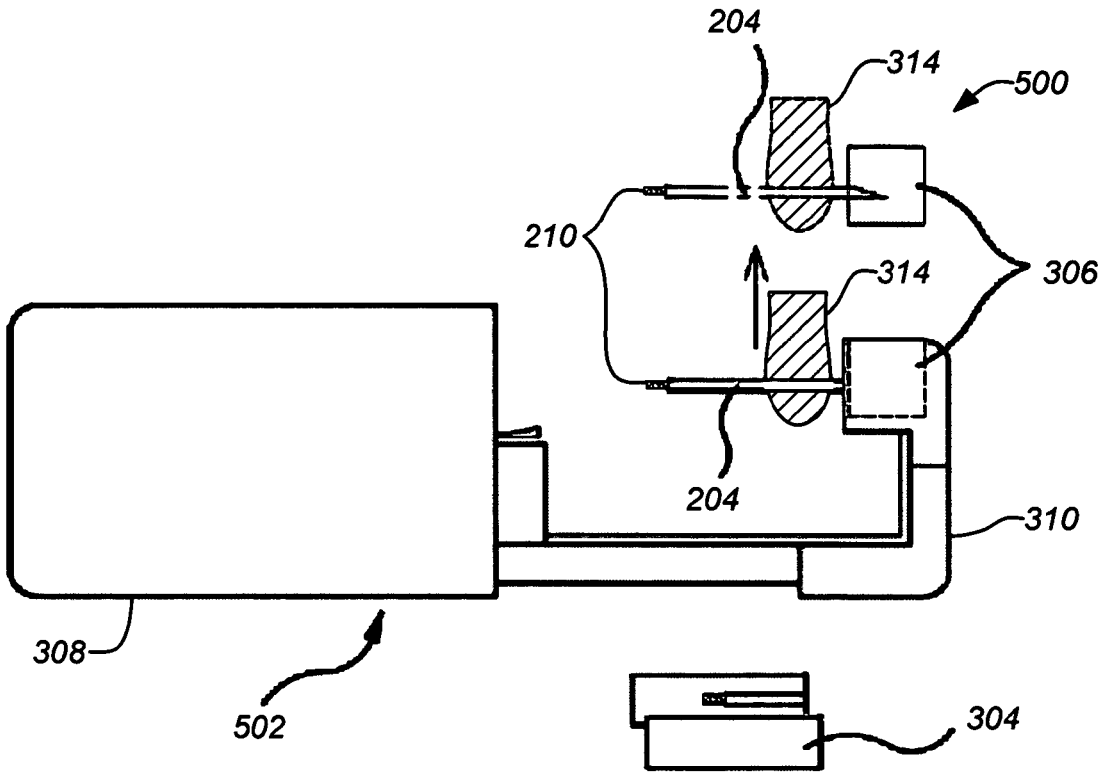

FIGS. 5B-5D illustrate operation of the alternate assembly 500 where the cartridge 502 is loaded with a coupling needle 202 alone. FIG. 5B shows the cartridge 502 in an open position ready for piercing with a body part 314 to be pierced disposed between the sharpened end 208 of the coupling needle 202 and the coupling needle manipulator 306. The first and second elements 308, 310 of the cartridge 502 are spring loaded apart with the internal spring 312 in a sliding engagement as shown. FIG. 5C shows the cartridge 502 in a closed position after piercing the body part 314. The sharpened end 208 of the coupling needle 202 has pierced the body part 314 and become embedded in the coupling needle manipulator 306. FIG. 5D shows the cartridge 502 after piercing, again in the open position. Upon release, the spring 312 serves to drive the two elements 308, 310 apart. This action also causes the carrier 304 to be drawn out of the first element 308 of the cartridge 502 because the coupling needle 202 is embedded and held in the coupling needle manipulator 306 and the sliding engagement of the two elements 308, 310 is parallel to the sliding engagement of the carrier 304. (In addition, the coupling needle manipulator 306 has a sliding engagement that is not parallel to that of the two elements 308, 310 which holds it in place during this motion.) After the carrier 304 is released from the first element 308, the two halves fall away and the pierced body part 314 is released as the coupling needle manipulator 306 is allowed to slide free from the second element 310 of the cartridge 502. Alternately, the coupling needle 202 may remain engaged in a single piece carrier 304 described above (not shown). At the other end, the coupling needle manipulator 306 serves to temporarily close off the piercing and prevents the coupling needle 202 from slipping out of the pierced body part 314 as the cartridge 302 is disengaged and released.

Figure 6A:
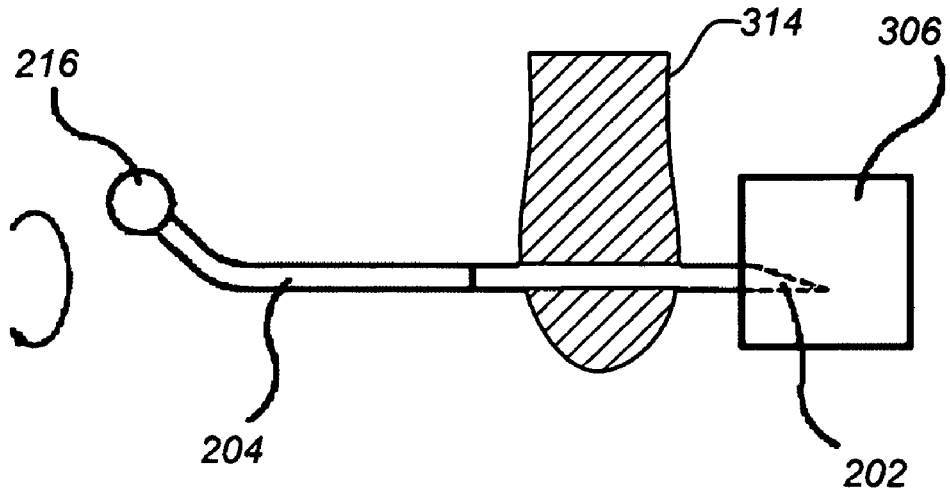
FIGS. 6A-6C illustrate further steps manipulating the coupling needle, ornamental piece and additional nut component to complete a piercing with the alternate embodiment of the invention.
Figure 6B:
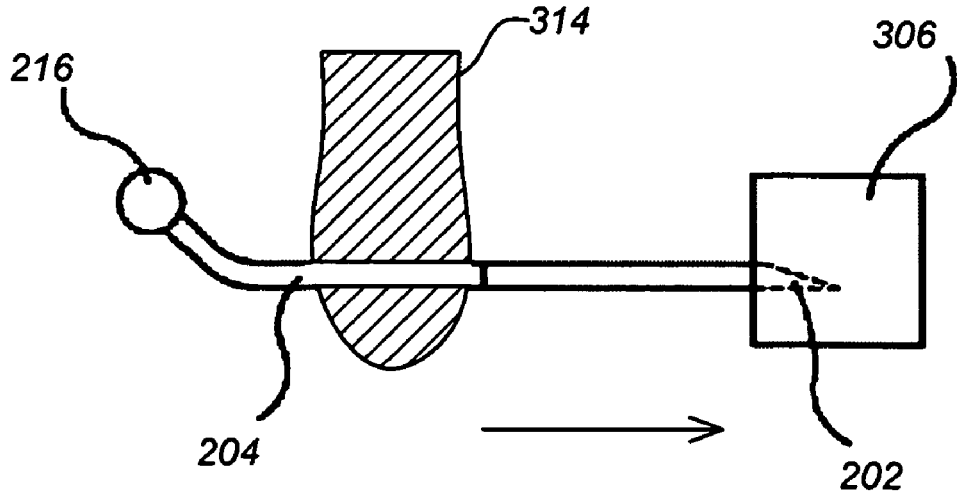
Figure 6C:
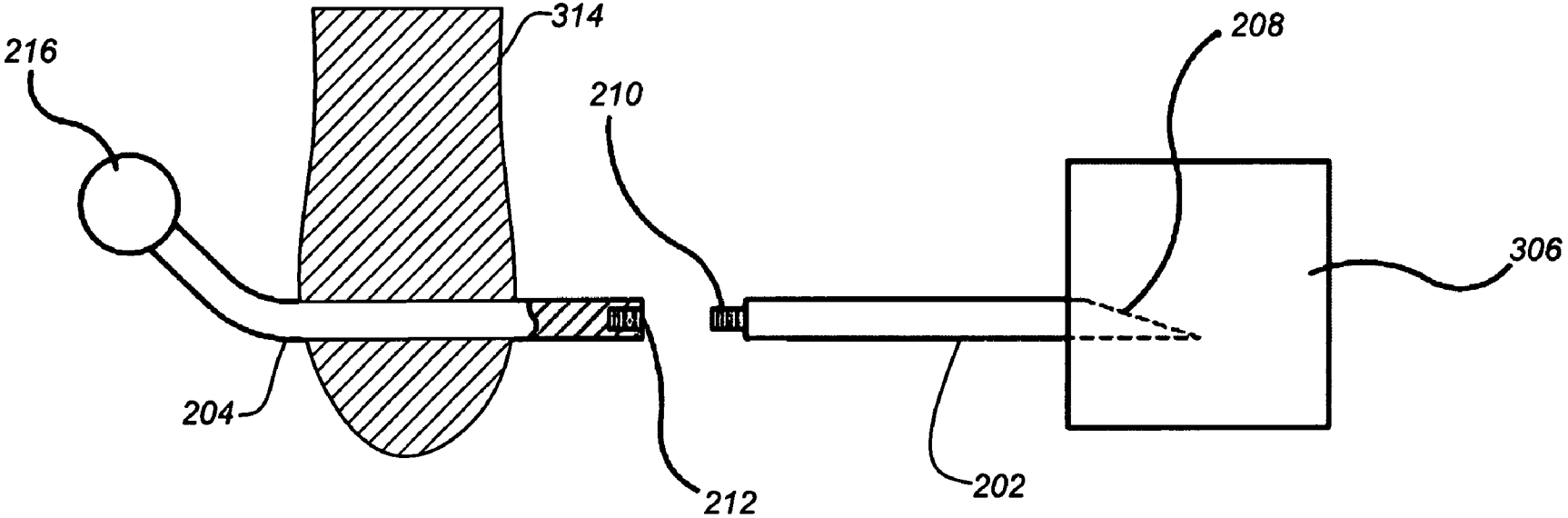

FIGS. 6A-6C illustrate further steps manipulating the coupling needle 202, ornamental piece 204 and coupling nut 206 components to complete a piercing with the alternate embodiment of the invention. FIG. 6A shows the pierced body part 314 on the coupling needle 202 with the sharpened end 208 still embedded in the coupling needle manipulator 306. The carrier 304 has been removed and an ornamental piece 204 has been selected and coupled to the coupling end 210 of the coupling needle 202. The ornamental piece 204 may be threaded onto the coupling needle 202 with the coupling needle manipulator 306 used to hold the coupling needle 202. FIG. 6B shows the ornamental piece 204 is now drawn through the pierced body part 314 with the coupling needle 202. The pierced body part 314 is drawn through until the coupled joint appears through the piercing. The coupling needle manipulator 306 may be used here as well.

FIG. 6C shows the coupling needle 202 is now decoupled from the ornamental piece 204 just as FIG. 4B previously described. The last step is to join a coupling nut 206 in place of the coupling needle 202 just as previously shown in FIG. 4C.

5.0 Method of Piercing with a Coupling Needle in a Cartridge

Embodiments of the invention also include methods of using the piercing assemblies 300, 500 described above. There is a common base of procedure for both assemblies 300, 500. However, an additional operation occurs with the assembly 500 that is not required for the assembly 300 as shall be described below.

Figure 7:
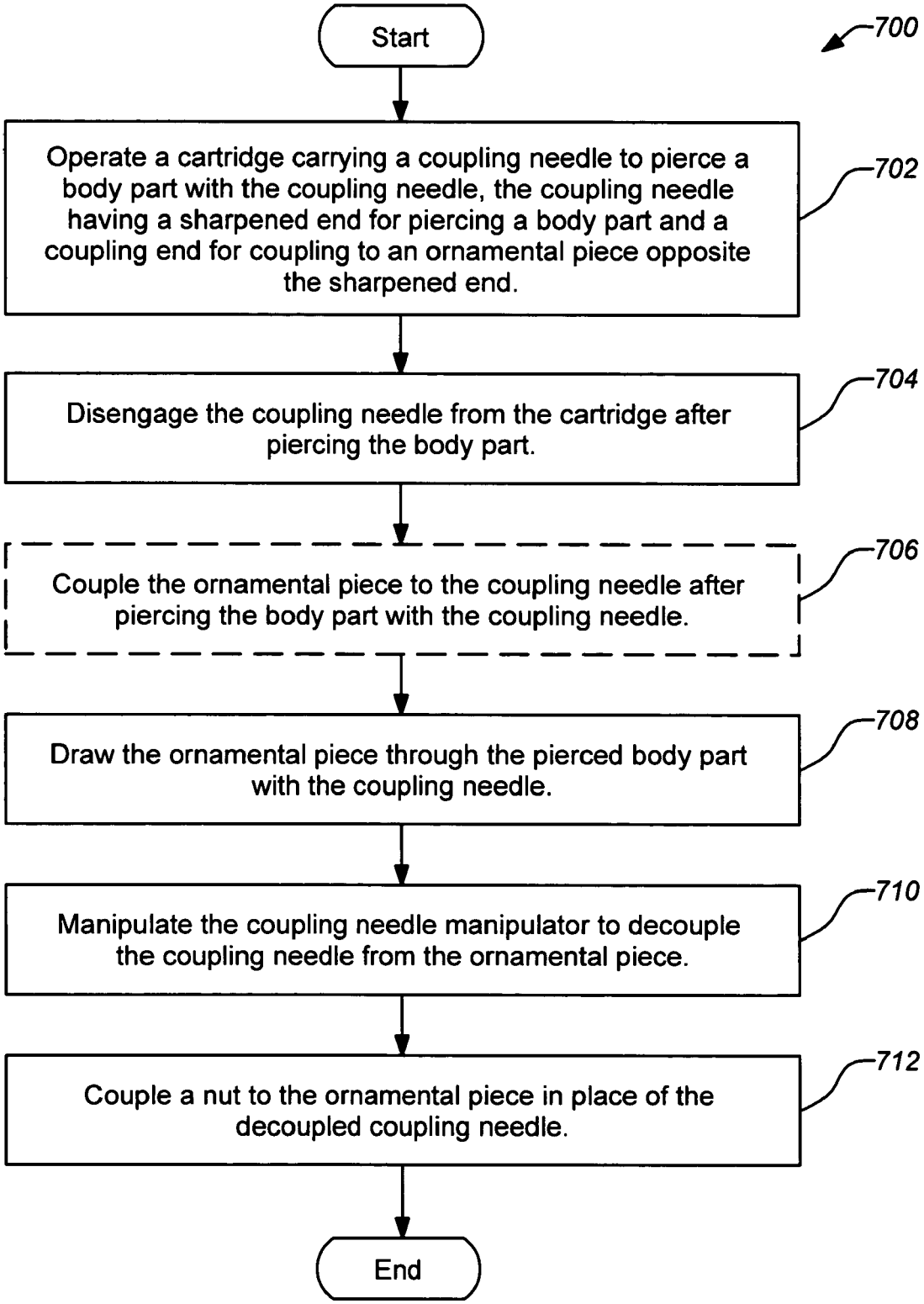
FIG. 7 is a flowchart of a method of piercing with a coupling needle in a cartridge.

FIG. 7 is a flowchart of a typical method 700 embodiment of the invention. First in operation 702, a cartridge carrying a coupling needle is operated to pierce a body part with the coupling needle. The coupling needle has a sharpened end for piercing a body part and a coupling end for coupling to an ornamental piece opposite the sharpened end. Next, in operation 704 the coupling needle is disengaged from the cartridge after piercing the body part.

Optional operation 706 only applies to the assembly 500 where the ornamental piece is not carried in the cartridge 502. In operation 706, the ornamental piece is coupled to the coupling needle after piercing the body part with the coupling needle.

The following operations 708-712 apply to both assemblies 300, 500. In operation 708, the ornamental piece is drawn through the pierced body part with the coupling needle. In operation 710, the coupling needle manipulator is manipulated to decouple the coupling needle from the ornamental piece. Finally, in operation 712, a nut is coupled to the ornamental piece in place of the decoupled coupling needle.

The method 700 may be further modified consistent with the apparatus embodiments previously described.

This concludes the description including the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching.

It is intended that the scope of the invention be limited not by this detailed description, but rather by the claims appended hereto. The above specification, examples and data provide a complete description of the manufacture and use of the apparatus and method of the invention. Since many embodiments of the invention can be made without departing from the scope of the invention, the invention resides in the claims hereinafter appended.

What is claimed is:

1. A body piercing assembly, comprising:

a coupling needle having a sharpened end for piercing a body part and a coupling end for coupling to an ornamental piece opposite the sharpened end; and a cartridge for carrying the coupling needle and for piercing the body part with the coupling needle, the cartridge including a coupling needle manipulator for engaging the sharpened end of the coupling needle after the body part is pierced such that the coupling needle manipulator then carries the coupling needle;

wherein the coupling end of the coupling needle comprises a thread for coupling to the ornamental piece and the thread is duplicated on a coupling nut for replacing the coupling needle and closing out the piercing of the body part and wherein the sharpened end comprises an asymmetric shape that becomes embedded in the coupling needle manipulator such that the coupling needle is rotated to disengage the thread without the sharpened end slipping in the coupling needle manipulator.

2. The body piercing assembly of claim 1, wherein the cartridge is sterile packaged.

3. The body piercing assembly of claim 1, wherein the ornamental piece is coupled to the coupling needle and carried within the cartridge.

4. The body piercing assembly of claim 1, wherein the coupling needle is carried within the cartridge without the ornamental piece and the ornamental piece is coupled to the coupling needle after piercing the body part with the coupling needle.

5. The body piercing assembly of claim 1, wherein the ornamental piece comprises a post and ornamental end.

6. The body piercing assembly of claim 5, wherein the post is straight.

7. The body piercing assembly of claim 5, wherein the post is curved.

8. A body piercing instrument, comprising:

a coupling needle means having a sharpened end for piercing a body part and a coupling end for coupling to an ornamental piece opposite the sharpened end; and a cartridge means for carrying the coupling needle means and for piercing the body part with the coupling needle, the cartridge means including a coupling needle manipulator for engaging the sharpened end of the coupling needle means after the body part is pierced such that the coupling needle manipulator then carries the coupling needle means;

wherein the coupling end of the coupling needle means comprises a thread for coupling to the ornamental piece and the thread is duplicated on a coupling nut means for replacing the coupling needle means and closing out the piercing of the body part and wherein the sharpened end comprises an asymmetric shape that becomes embedded in the coupling needle manipulator such that the coupling needle means is rotated to disengage the thread without the sharpened end slipping in the coupling needle manipulator.

9. A method of body piercing, comprising the steps of:

operating a cartridge carrying a coupling needle to pierce a body part with the coupling needle, the coupling needle having a sharpened end for piercing a body part and a coupling end for coupling to an ornamental piece opposite the sharpened end, the cartridge including a coupling needle manipulator for engaging the sharpened end of the coupling needle after the body part is pierced such that the coupling needle manipulator then carries the coupling needle; and disengaging the coupling needle from the cartridge after piercing the body part;

wherein the coupling end of the coupling needle comprises a thread for coupling to the ornamental piece and the thread is duplicated on a coupling nut for replacing the coupling needle and closing out the piercing of the body part and wherein the sharpened end comprises an asymmetric shape that becomes embedded in the coupling needle manipulator such that the coupling needle is rotated to disengage the thread without the sharpened end slipping in the coupling needle manipulator.

10. The method of claim 9, wherein the cartridge is sterile packaged.

11. The method of claim 9, wherein the ornamental piece is coupled to the coupling needle and carried within the cartridge.

12. The method of claim 9, further comprising coupling the ornamental piece to the coupling needle after piercing the body part with the coupling needle;

wherein the coupling needle is carried within the cartridge without the ornamental piece.

13. The method of claim 9, further comprising drawing the ornamental piece through the pierced body part with the coupling needle;

manipulating the coupling needle manipulator to decouple the coupling needle from the ornamental piece; and then coupling the coupling nut to the ornamental piece in place of the decoupled coupling needle.

14. The method of claim 13, wherein the ornamental piece is coupled to the coupling needle and carried within the cartridge.

15. The method of claim 13, further comprising coupling the ornamental piece to the coupling needle after piercing the body part with the coupling needle;

wherein the coupling needle is carried within the cartridge without the ornamental piece.

16. The method of claim 9, wherein the ornamental piece comprises a post and ornamental end.

17. The method of claim 16, wherein the post is straight.

18. The method of claim 16, wherein the post is curved.

* * * * *